US006480153B1

(12) United States Patent
Jung et al.

(10) Patent No.: US 6,480,153 B1
(45) Date of Patent: Nov. 12, 2002

(54) CALIBRATION APPARATUS OF ADAPTIVE ARRAY ANTENNA AND CALIBRATION METHOD THEREOF

(75) Inventors: Jae Ho Jung, Taejon (KR); Hyeong Geon Park, Taejon (KR); Hyun Seo Oh, Taejon (KR); Mun Geon Kyeong, Taejon (KR)

(73) Assignee: Electronics and Telecommunications Research Institute, Taejon (KR)

( * ) Notice: Subject to any disclaimer, the term of this patent is extended or adjusted under 35 U.S.C. 154(b) by 0 days.

(21) Appl. No.: 09/995,838

(22) Filed: Nov. 29, 2001

(30) Foreign Application Priority Data

Aug. 7, 2001 (KR) ..... 01-47552

(51) Int. Cl.[7] ..... H01Q 3/22
(52) U.S. Cl. ..... 342/368; 342/174
(58) Field of Search ..... 342/165, 174, 342/368, 369, 374

(56) References Cited

U.S. PATENT DOCUMENTS 5,248,982 A 9/1993 Reinhardt et al.
5,530,449 A 6/1996 Wachs et al.
6,157,343 A 12/2000 Andersson et al.

*Primary Examiner*—Dao Phan
(74) *Attorney, Agent, or Firm*—Jacobson Holman PLLC

(57) ABSTRACT

The present invention utilizes a calibration signal weight vector as a response vector corresponding to a predetermined orientation angle of the antenna, thereby reducing an interference signal and enhancing a data communication effectively. The calibration method of an array antenna begins with generating a calibration signal in order to measure a transfer function of an array receiving means. A calibration signal vector is injected into the array receiver/transmitter, after multiplying a divided calibration signal and a predetermined weight vector corresponding to each channel together. The divided calibration signal is obtained by dividing the calibration signal by total number of channels. A calibration coefficient is obtained by using that the transfer function of each channel is estimated by analyzing the signal injected from the array receiver or transmitter. Finally, an interference signal is eliminated, by multiplying the received signal of a baseband and the calibration coefficient together.

20 Claims, 6 Drawing Sheets

CALIBRATION APPARATUS OF ADAPTIVE ARRAY ANTENNA AND CALIBRATION METHOD THEREOF

FIELD OF THE INVENTION

The present invention relates to a calibration system of an adaptive array antenna; and, more particularly, to a calibration apparatus of the adaptive array antenna and a calibration method thereof, being capable of estimating and calibrating a transfer function corresponding to each channel without interfering with the other's signal.

DESCRIPTION OF THE PRIOR ART

In general, an adaptive array antenna is employed in a wireless communication system because an antenna beam can be oriented to an aimed direction adaptively. Thus, the adaptive array antenna system provides a high antenna gain and an improved signal-to-noise ratio (SNR).

Furthermore, the adaptive array antenna which is embodied by a digital beamforming method for transmitting/receiving a plurality of signals simultaneously in a mobile communication base station, has an advantage of reducing an interference signal against the other signals because the antenna beam is formed independently for each signal.

The digital beamforming method controls an orientation angle and a sidelobe level of the array antenna by means of multiplying a transmitting/receiving signal and a beamforming weight together at a baseband. In this case, the transmitting/receiving signals from an array antenna system is assumed to be identical for an accurate the direction of arrival estimation and beamforming. Therefore, it is necessary to estimate and calibrate a transfer function of a transceiver exactly. Generally, the transfer function of the transceiver representing an amplitude and a phase is different from each other for each channel due to a characteristic of a radio frequency (RF) parts. Thus, it is necessary to perform a calibration step to measure and calibrate the transfer function periodically.

A conventional method for estimating the transfer function of the multi-channel transceiver uses the method to inject a calibration signal into each channel and to analyze the calibration signal transmitted through the transceiver.

The transfer function of each channel in an array antenna system is not only varied according to the change of the time but also changed by environmental conditions such as a temperature, a moisture and the like, whereby it is necessary to estimate and calibrate the transfer function periodically during the system's working. However, there is a drawback that the calibration signal may interfere an original signal to transmit or be received through the adaptive array antenna when the calibration signal is injected into each channel.

To overcome the above drawback, there is announced a prior art which is disclosed in U.S. Pat. No. 5,530,449, entitled "Phase Array Antenna Management System and Calibration Method". In the disclosure, when a reference signal is formed in order to reduce the interference with the other user's signal in the adaptive antenna system, an orthogonal-code modulated signal of a low voltage having a narrower bandwidth than a signal bandwidth, is used.

However, it is impossible to generate the orthogonal-code modulated signal uncorrelated with receiving a plurality of signals when the prior art is applied to an array receiving system in a code division multiple access (CDMA) mobile communication environment.

There is the other prior art disclosed in U.S. Pat. No. 5,248,982, entitled "Method and Apparatus for Calibration Phased Array Receiving Antennas". This prior art is related to the method for injecting two reference signals modulated to the orthogonal-code into each different transmission line. This method has an advantage that the effect of a signal line may be eliminated to apply the reference signal. However, the lengths of two reference signal input lines should be symmetric to each input terminal, and further it is difficult to reduce the interference with the other user's signal.

SUMMARY OF THE INVENTION

It is, therefore, an object of the present invention to provide a calibration apparatus of an adaptive array antenna utilizing a calibration signal with low correlation to an array manifold as multiplying by a weight vector corresponding to a predetermined array response vector of the antenna, thereby reducing an interference signal.

It is another object of the present invention to provide a calibration method of an adaptive array antenna utilizing a calibration signal with low correlation to an array manifold as multiplying by a weight vector corresponding to a predetermined array response vector of the antenna, thereby reducing an interference signal.

It is further another object of the present invention to provide a computer-readable media for performing a calibration method of an adaptive array antenna utilizing a calibration signal with low correlation to an array manifold as multiplying by a weight vector corresponding to a predetermined array response vector of the antenna, thereby reducing an interference signal.

In accordance with an aspect of the present invention, there is provided a calibration apparatus of an adaptive array receiving antenna system having a plurality of array antennas, the calibration apparatus comprising: a calibration signal generating unit for generating a calibration signal of a baseband as the calibration signal of a radio frequency (RF) band; a calibration signal injection unit for injecting a calibration signal vector into an array receiving unit, wherein the calibration signal vector is produced by multiplying a divided signal by a predetermined weight corresponding to each channel, the divided signal being made by dividing the signal received from the calibration signal generating unit by total number of channels; a plurality of array receiving unit for adding the signal received from the calibration signal injection unit and the signal received by the array antenna devices, and for converting the signal of the RF band into the signal of the baseband; a calibration coefficient estimation unit for estimating a transfer function of each channel by correlating the signal received from the calibration signal generating unit with the signal received from the array receiving unit, and for finding out a calibration coefficient by using an estimated transfer function; and a calibration unit for eliminating an interference component by multiplying the signal received from the array receiving unit and the inverse of calibration coefficient together.

In accordance with another aspect of the present invention, there is provided a calibration apparatus of an adaptive array transmitting antenna system having a plurality of array antennas, the calibration apparatus comprising: a vector addition unit for adding each output of each beamforming unit; a calibration signal generating unit for generating a calibration signal to be injected into a channel for estimating a transfer function; a calibration signal injection unit for injecting a calibration signal vector added by the signal received from the vector addition unit, into a calibration unit; an array transmission unit for converting a digital data to an analog data, and for up-converting to an RF band; a coupling unit for interlocking a switch unit with the signal received from the array transmission unit; an exchange unit for selecting a path or a circuit of the signal received from the coupling unit; a calibration signal receiving unit for converting the signal received from the exchange unit from the RF band into the baseband; a calibration coefficient estimation unit for finding out a calibration coefficient by using that the transfer function of the array transmission unit is estimated sequentially through the calibration signal received from the calibration signal receiving unit; and a calibration unit for eliminating an interference signal by unit of multiplying the signal received from the calibration signal injection unit by an inverse of the transfer function estimated from the calibration coefficient estimation unit.

In accordance with further another aspect of the present invention, there is provided a calibration method of an adaptive array receiving antenna, the method comprising the steps of: a) generating a calibration signal in order to measure a transfer function of an array receiving unit; b) injecting a calibration signal vector into the array receiving unit, wherein the calibration signal vector is produced by multiplying a divided calibration signal and a predetermined weight vector corresponding to each channel together, the divided calibration signal being the calibration signal divided by total number of channels; c) finding out a calibration coefficient by using that the transfer function of each receiving channel is estimated by analyzing the signal injected from the array receiving unit; and d) generating a receive signal that an interference signal is eliminated, by multiplying the received signal of a baseband and the calibration coefficient together.

In accordance with further another aspect of the present invention, there is provided a calibration method of in an adaptive array transmitting antenna, the method comprising the steps of: a) generating a calibration signal in order to measure the transfer function of an array transmission unit; b) injecting a calibration signal vector into the array transmission unit, wherein the calibration signal vector is produced by multiplying the calibration signal and a predetermined weight vector corresponding to each channel together; c) finding out a calibration coefficient by using that the transfer function of each receiving channel is estimated by analyzing a down-converted signal after down-converting the signal injected from the array transmission unit; and d) generating a transmission signal that an interference signal is eliminated, by multiplying the transmission signal and the calibration coefficient together.

In accordance with further another aspect of the present invention, there is provided a computer-readable media storing software program instructions, the software program instructions disposed on a computer to perform a calibration method of an adaptive array receiving antenna, comprising the steps of: a) generating a calibration signal in order to measure a transfer function of an array receiving unit; b) injecting a calibration signal vector into the array receiving unit, wherein the calibration signal vector is produced by multiplying a divided calibration signal and a predetermined weight vector corresponding to each channel together, the divided calibration signal being the calibration signal divided by total number of channels; c) finding out a calibration coefficient by using that the transfer function of each receiving channel is estimated by analyzing the signal injected from the array receiving unit; and d) generating a receive signal that an interference signal is eliminated, by multiplying the received signal of baseband and the calibration coefficient together.

In accordance with still further another aspect of the present invention, there is provided a computer-readable media storing software program instructions, the software program instructions disposed on a computer to perform a calibration method of an adaptive array transmitting antenna, comprising the steps of: a) generating a calibration signal in order to measure the transfer function of an array transmission unit; b) injecting a calibration signal vector into the array transmission unit, wherein the calibration signal vector is produced by multiplying the calibration signal and a predetermined weight vector corresponding to each channel together; c) finding out a calibration coefficient by using that the transfer function of each receiving channel is estimated by analyzing a down-converted signal after down-converting the signal injected from the array transmission unit; and d) generating a transmission signal that an interference signal is eliminated, by multiplying the transmission signal and the calibration coefficient together.

BRIEF DESCRIPTION OF THE DRAWINGS

The above and other objects and features of the present invention will become apparent from the following description of the preferred embodiment given in conjunction with the accompanying drawings, in which.

DETAILED DESCRIPTION OF THE PREFERRED EMBODIMENTS

Figure 1:
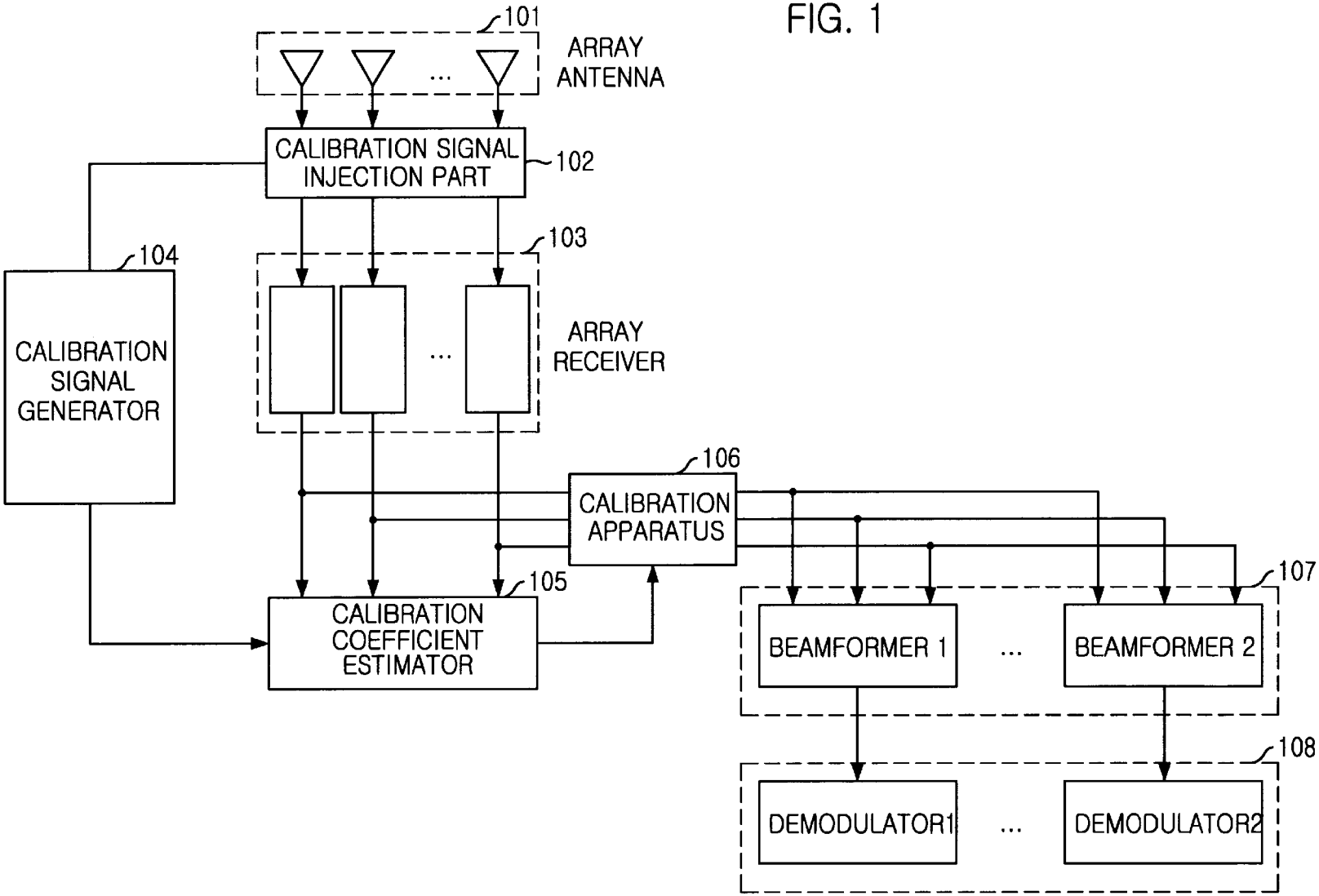
FIG. 1 is a schematic view setting forth an adaptive array receiving antenna system in accordance with a preferred embodiment of the present invention.

Referring to FIG. 1, there is shown a schematic view setting forth an adaptive array receiving antenna in accordance with a preferred embodiment of the present invention. The adaptive array receiving antenna comprises an array antenna 101, a calibration signal injection part 102, an array receiver 103, a calibration signal generator 104, a calibration coefficient estimator 105, a calibration apparatus 106, array beamformer 107 and a demodulator 108.

The array antenna 101 including a plurality of radiation elements is connected to the calibration signal injection part 102 and the array receiver 103. The array receiver 103 plays a role in converting a down-converted radio frequency (RF) signal to a digital signal, wherein the RF signal is received through the array antenna 101 and transmitted to the array receiver 103 through the calibration signal injection part 102. The calibration signal generator 104 plays a role in up-converting the calibration signal generated in a baseband to the signal of the RF band, thereby making the calibration signal injection part 102 generate the calibration signal which will be injected into the array receiver 103. The calibration signal injection part 102 plays a role in injecting the calibration signal to the array receiver 103, after the RF calibration signal is divided by total number of channels and then is multiplied by each predetermined weight corresponding to each channel. Therefore, an output of the array receiver 103 is represented as a summation of the signal received from the array antenna 101 and the calibration signal, which is described in an equation 1.

$$y(t) = H_r\left[\sum_i a(\theta_i)s_i(t) + \alpha\, p(t)\right] \quad \text{(Eq. 1)}$$

where,

- $y(t)$ denotes a digital received data,
- $s_i(t)$ represents an i-th signal received through the array antenna 101 at an angle of $\theta_i$,
- $a(\theta_i)$ is an array response vector corresponding to the i-th signal,
- $p(t)$ denotes the calibration signal injected in the calibration signal injection part,
- $\alpha=[\alpha_1,\alpha_2,\Lambda,\alpha_M]$ denotes a weight column vector corresponding to calibration signal to generate the noninterfering calibration signal, and
- $H_r=\mathrm{diag}\{h_{r,1},h_{r,2},\Lambda,h_{r,M}\}$ is a diagonal matrix and each diagonal component of the matrix represents a transfer function of each receiver.

The calibration coefficient estimator 105 plays a role in correlating the calibration signal transmitted through the array receiver 103 and the calibration signal generated from the calibration signal generator 104, thereby estimating the transfer function of the array receiver 103 corresponding to each channel.

$$\hat{h}_r=\Lambda^{-1}[E\{y(t)p^*(t)\}] \quad \text{(Eq. 2)}$$

where, $\hat{h}_r=[\hat{h}_{r,1},\hat{h}_{r,2},\Lambda,\hat{h}_{r,M}]^T$ is an estimated transfer function represented as the column vector, and $\Lambda=\mathrm{diag}[\alpha_1,\alpha_2,\Lambda,\alpha_M]$ is a weight matrix of the calibration signal represented as the diagonal matrix.

By converting the estimated transfer function to an inverse diagonal matrix, it is possible to obtain a calibration coefficient as expressed in equation 3.

$$C_r=diag\{\hat{h}_{r,1}^{-1},\hat{h}_{r,2}^{-1},\Lambda,\hat{h}_{r,M}^{-1}\} \quad \text{(Eq. 3)}$$

where, $C_r$ is the diagonal matrix and each component of the matrix represents calibration coefficient for each channel, and $\hat{h}_{r,j}$ is an estimation value of the transfer function corresponding to a j-th receiving channel.

The calibration apparatus 106 eliminates a different component of the transfer function for each channel by multiplying the digital signal received through the array antenna 103 by the calibration coefficient. Furthermore, the array beamformer 107 includes a plurality of beamformeres therein, wherein each beamformer 107 is oriented to each different direction of the signal. Generally, the output of the beamformer 107 has an interference signal as well as an intended signal. At this time, providing that the transfer function of the array receiver 103 is eliminated at the calibration apparatus 106 exactly, a remained power, i.e., $P_p$, of the calibration signal of the output of the beamformer 107 is simulated as a following equation 4.

$$P_p=|w_i^{11}\alpha|^2\rho_p^2 \quad \text{(Eq. 4)}$$

where, $\rho_p^2=E\{|p(t)|^2\}$ is a power of the calibration signal, $\alpha$ is a calibration signal weight vector, and $w_i$ is a beamforming weight vector corresponding to i-th beamformer.

From this equation 4, it is understood that the remained power of the beamformer 107 is varied by the calibration signal weight vector when the power of the calibration signal is fixed to be constant.

In general, the beamforming weight vector has high correlation to the array response vector corresponding to the range of the angle which the adaptive array antenna is oriented to. Therefore, the power of the calibration signal is reduced at the output of the beamformer 107 provided that the calibration signal weight vector, i.e., $\alpha$, is set to a predetermined value that the array response vector has little correlation with the range of the angle.

Figure 2:
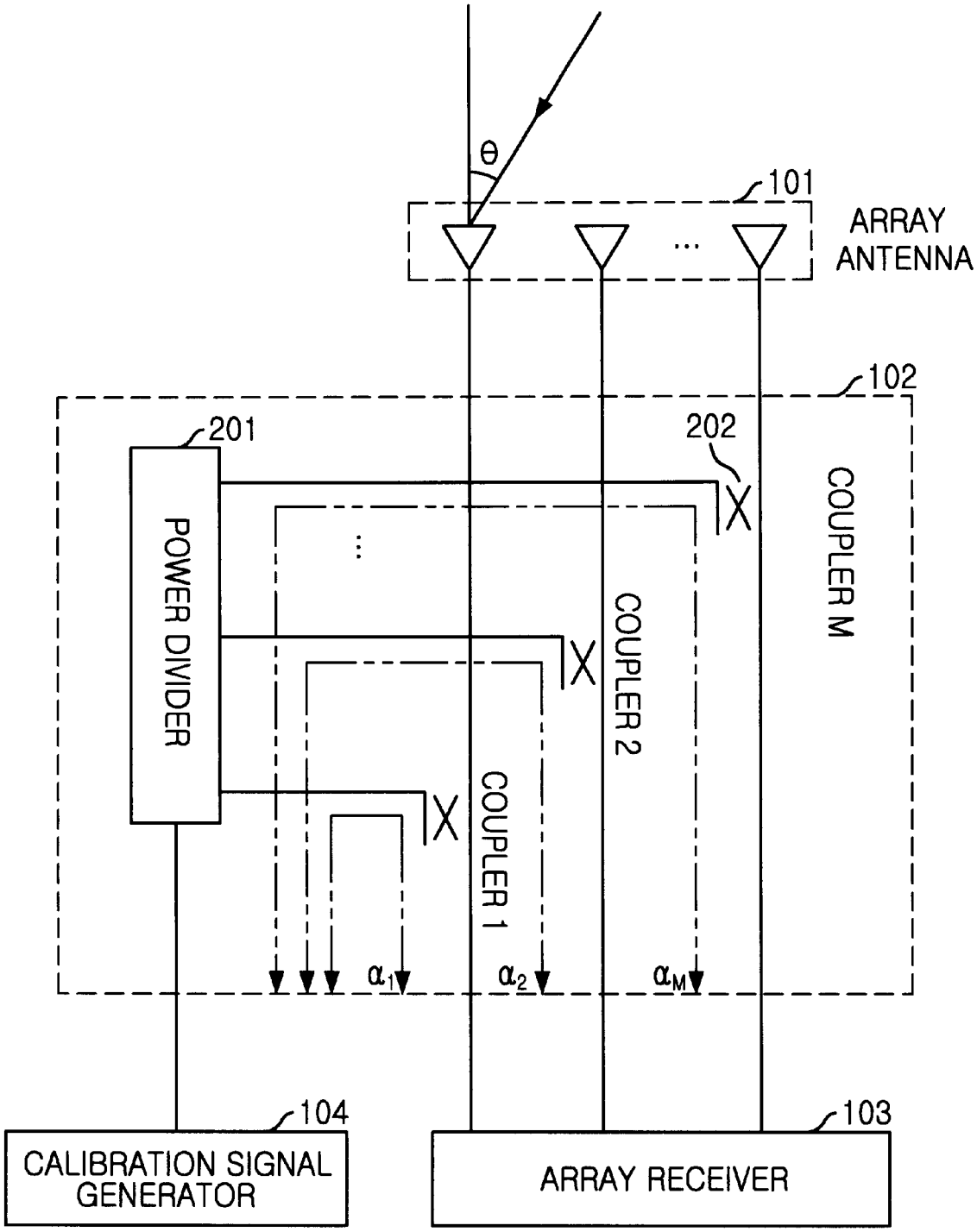
FIG. 2 is a schematic view illustrating a calibration apparatus of the adaptive array receiving antenna in accordance with the present invention.

Referring to FIG. 2, there is shown the calibration apparatus of the adaptive array antenna in accordance with the present invention. The calibration apparatus comprises a calibration signal injection part 102, an array receiver 104 and a calibration signal generator 104, wherein the calibration signal injection part 102 includes a power divide 201 and a plurality of couplers 202.

The signal received by the array antenna 101 has a different amplitude and a phase for each channel at the output terminal of the calibration signal injection part 102 according to an incident angle, which is denoted $\theta$ in FIG. 2. This is called an array response vector.

$$a(\theta)=[\alpha_1,\alpha_2,\Lambda,\alpha_M]^T \quad \text{(Eq. 5)}$$

where, $a(\theta)$ is the array response vector, $a_j$ is the amplitude and the phase of the signal inputted through a j-th radiation element of the antenna. The power divider 201 plays a role in dividing the signal received from the calibration signal generator 104 by total number of channels. In addition, the couplers 202 play a role in injecting the signal received from the power divider 201 after the signal is multiplied by the predetermined weight corresponding to each channel. The calibration signal generated from the calibration signal generator 104 is injected into each channel of the array receiver 103 through the power divider 201 and the couplers 202. The weight vector of the calibration signal is determined by the characteristic of the transfer function of the calibration signal injection part 102.

$$\alpha=[\alpha_1,\alpha_2,\Lambda,\alpha_M] \quad \text{(Eq. 6)}$$

where, $\alpha$ is the calibration signal weight vector, and $\alpha_j$ is the transfer function corresponding to the j-th channel of the calibration signal injection part 102.

The transfer functions of the calibration signals corresponding to each channel can be controlled by modulating the characteristic of the transfer function of the power divider 201 and the length of the transmission line. Accordingly, it is possible to adjust the calibration signal weight vector that the array response vector has little correlation to the orientation angle of the adaptive array antenna.

Figure 3:
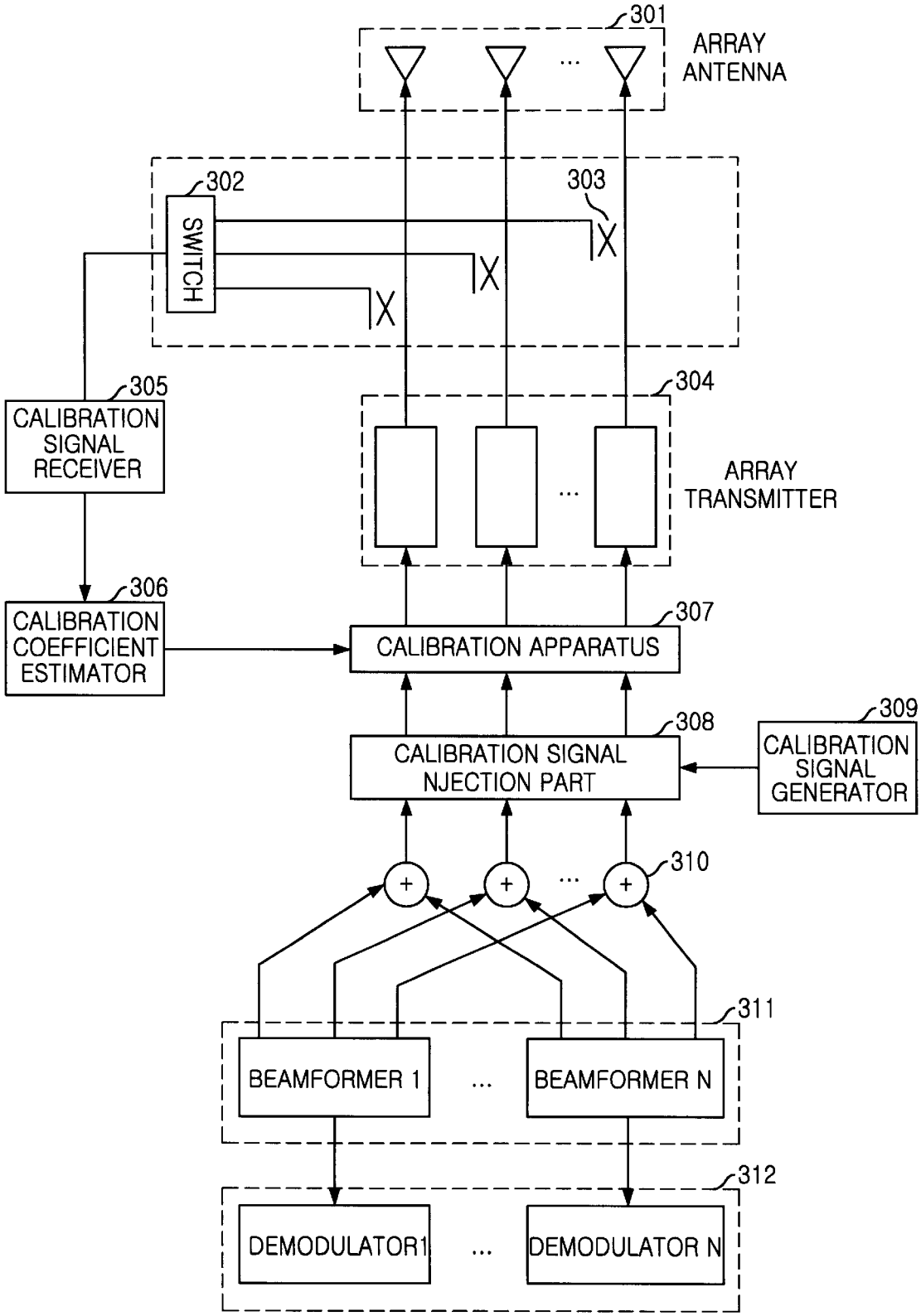
FIG. 3 is a schematic view explaining an adaptive array transmitting antenna in accordance with the present invention.

Referring to FIG. 3, there is shown a schematic view setting forth an adaptive array transmitting antenna in accordance with the present invention. The adaptive array transmitting antenna includes an array antenna 301, a switch 302, a plurality of couplers 303, an array transmitter 304, a calibration signal receiver 305, a calibration apparatus 307, a calibration signal injection part 308, a calibration signal generator 309, a plurality of vector adders 310, an array beamformer 311 and an array modulator 312.

The array modulator 312 is used to generate each data, i.e., $s_i(t)$, to transmit and the beamformer 311 is used to transfer the data generated from the array modulated 312 to the vector adder 310 after multiplying the data by the beamforming weight, i.e., $w_i$. The vector adder 310 plays a role in transferring an output vector to the calibration signal injection part 308 after adding each output of the beamformer 311.

The calibration signal generator 309 is used to generate the digital calibration signal, i.e., p(t), to be injected into the channel, wherein the digital calibration signal is used to estimate the transfer function of the array transmitter 304. The calibration signal injection part 308 plays a role in generating the digital data, i.e., y(t), wherein the value of y(t) is the summation of the output vector of the vector adder 310 and the calibration signal vector multiplied the digital calibration signal, i.e., p(t), by the weight vector, i.e., $\alpha$. This is described as an equation 7 as below.

$$y(t) = \hat{H}_t\left[\sum_i w_i s_i(t) + \alpha p(t)\right] \quad \text{(Eq. 7)}$$

The calibration coefficient estimator 306 plays a role in correlating the calibration signal transmitted through the array transmitter 304 and the calibration signal generated from the calibration signal generator 309, thereby estimating the transfer function of the array transmitter 304 corresponding to each channel. This is described in an equation 8.

$$\hat{h}_i=\Lambda^{-1}[E\{y(t)p^*(t)\}] \quad \text{(Eq. 8)}$$

where, $\hat{h}_t=[\hat{h}_{t,1},\hat{h}_{t,2}\Lambda,\hat{h}_{t,M}]^T$ is the estimated transfer function represented as the column vector, and $\Lambda=\text{diag}\{\alpha_1, \alpha_2,\Lambda,\alpha_M\}$ is a weight matrix of the calibration signal represented as the diagonal matrix.

The calibration apparatus 307 is used to multiply the inverse of the transfer function of the array transmitter 304 for transferring the signal generated at the baseband to the array antenna 301 while the characteristic of the signal is not changed. The calibration coefficient, i.e., $C_t$, is the diagonal matrix and each component of the matrix is a calibration coefficient corresponding to each transmission channel.

$$C_t=diag\{\hat{h}_{t,1}^{-1},\hat{h}_{t,2}^{-1}, \Lambda,\hat{h}_{t,M}^{-1}\} \quad \text{(Eq. 9)}$$

where, $h_{t,j}$ is the estimation value of the transfer function of the j-th transmission channel.

The array transmitter 304 is used to convert the digital data corresponding to each channel into the analog data and to up-convert to the RF band. A portion of the up-converted calibration signal is down-converted at the calibration receiver 305 after passing through the coupler 303 and the switch 302. The switch 302 plays a role in connecting the array transmitter 304 and the calibration signal receiver 305, sequentially.

The calibration coefficient estimator 306 is used to analyze the calibration signal and estimate the transfer function of the array transmitter 304. Thereafter, on the basis of the above result, the calibration coefficient estimator 306 plays a role in estimating the calibration coefficient, i.e., $C_t$. If a transfer function error of the array transmitter 304 is eliminated exactly at the calibration apparatus 307, the signal generated at the output terminal of the array antenna 301 is identical to the output vector, i.e., y(t), of the calibration signal injection part 308. Accordingly, the power of the calibration signal transmitted from the array antenna 301 is expressed as a following equation 10.

$$P_p=|a^H(\theta)\alpha|^2\pi_p^2 \quad \text{(Eq. 10)}$$

where, $\rho_p^2=E\{|p(t)|^2\}$ is the power of the calibration signal, and $a(\theta)$ is the response vector of the array antenna 301 corresponding to the angle $\theta$.

As similar as the adaptive array receiving antenna system, it is understood that it is possible to reduce the interference with the other signal when the calibration signal weight vector, i.e., $\alpha$, has little correlation with the orientation angle of the system.

Figure 4:
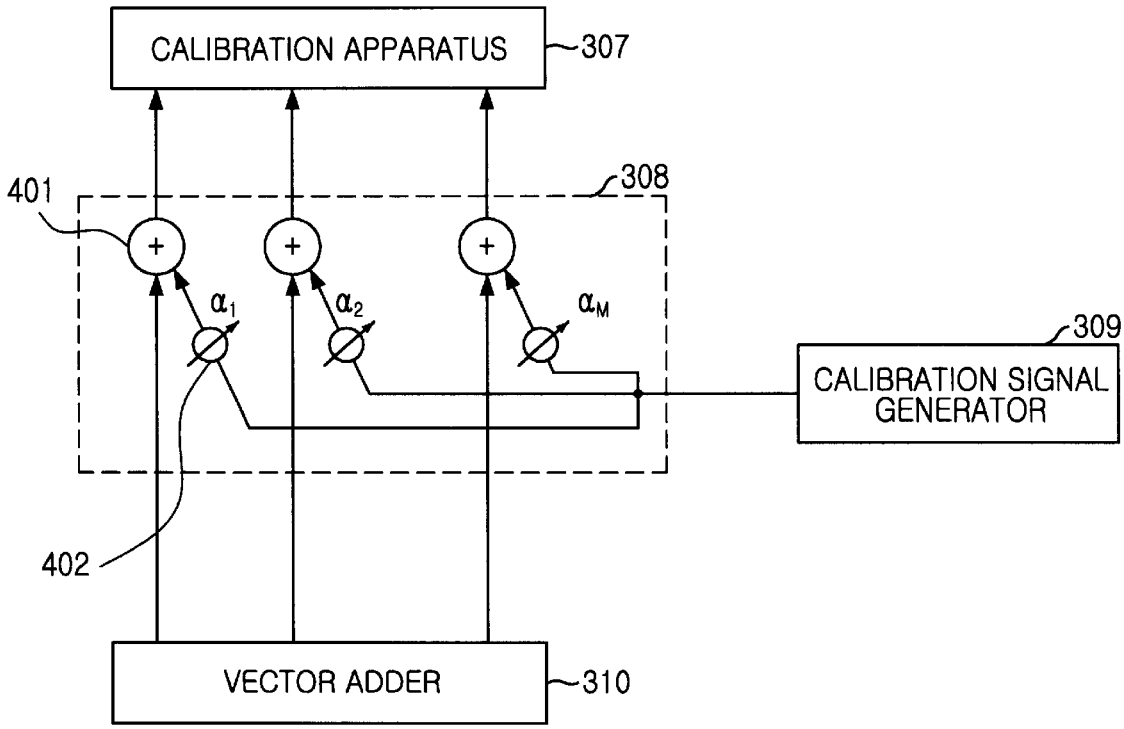
FIG. 4 is a schematic view representing a calibration apparatus of the adaptive array transmitting antenna in accordance with the present invention.

Referring to FIG. 4, there is shown a calibration apparatus of the adaptive array transmitting antenna in accordance with the present invention, comprising a calibrator 307, a calibration signal injection part 308, a calibration signal generator 309 and a vector adder 310. The calibration signal injection part 308 includes a plurality of adders 401 and a plurality of multipliers 402.

The adders 402 play a role in transferring the summation of the calibration signal multiplied by each different weight vector and the transmission data outputted from the vector adder 310 into the calibrator 307. The multipliers 402 are used to multiply the calibration signal by the complex weight.

Figure 5:
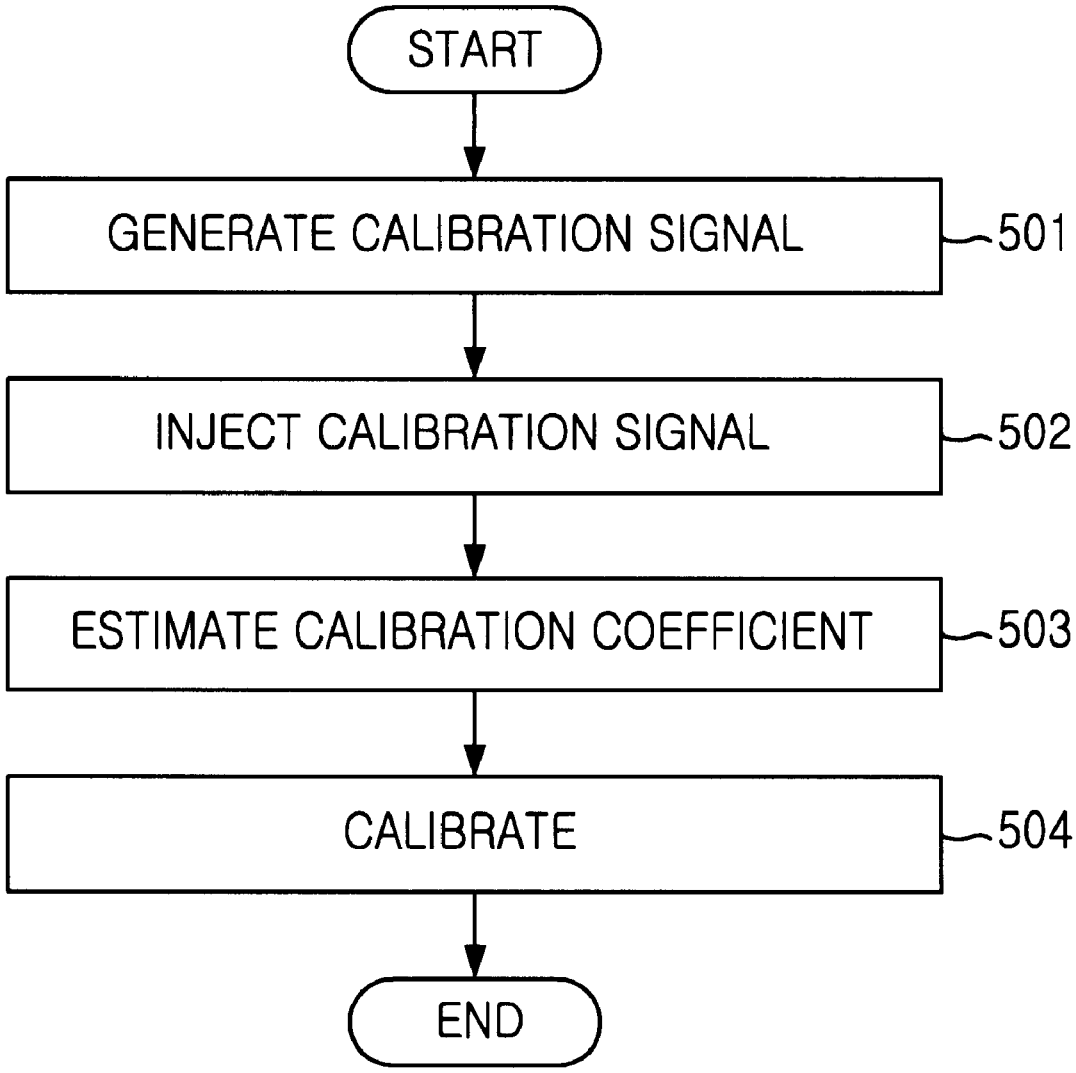
FIG. 5 is a flow chart setting forth a calibration method of the adaptive array antenna system in accordance with the present invention.

Referring to FIG. 5, there is shown a flow chart setting forth a calibration method of the adaptive array antenna system in accordance with a preferred embodiment of the present invention.

As represented in FIG. 5, the calibration method for the adaptive array receiving antenna system begins with producing the calibration signal for measuring the transfer function of the array receiver and up-converting to the RF band, indicated by a step 501.

In a next step, the calibration signal is multiplied by the weight vector and then is injected into the array receiver 104, wherein the weight vector has little correlation to the array response vector corresponding to the orientation angle of the receiving antenna, indicated by a the step 502.

Thereafter, the calibration signal passed through the array receiver 103 is analyzed and the transfer function of each channel is estimated, thereby obtaining the calibration coefficient, indicated by a step 503.

Finally, the calibration coefficient is applied to the received signal of the array receiver 103 to eliminate different components of the transfer function so that a calibrated signal is produced, indicated by a step 504.

Meanwhile, the calibration method for the adaptive array transmitting antenna begins with producing the calibration signal of the baseband in order to measure the transfer function of the array transmitter 304, indicated by a step 501.

Subsequently, the calibration signal is multiplied by the weight vector and then is injected into the array transmitter 304, wherein the weight vector has little correlation to the array response vector corresponding to the orientation angle of the transmitting antenna, indicated by a step 502.

Thereafter, the calibration signal passed through the array transmitter 304 is analyzed and the transfer function of each channel is estimated, thereby obtaining the calibration coefficient, indicated by a step 503.

Finally, the calibration coefficient is adjusted to the received signal of the array transmitter 304 to eliminate the different transfer function so that calibrated signal is produced, indicated by a step 504.

Figure 6:
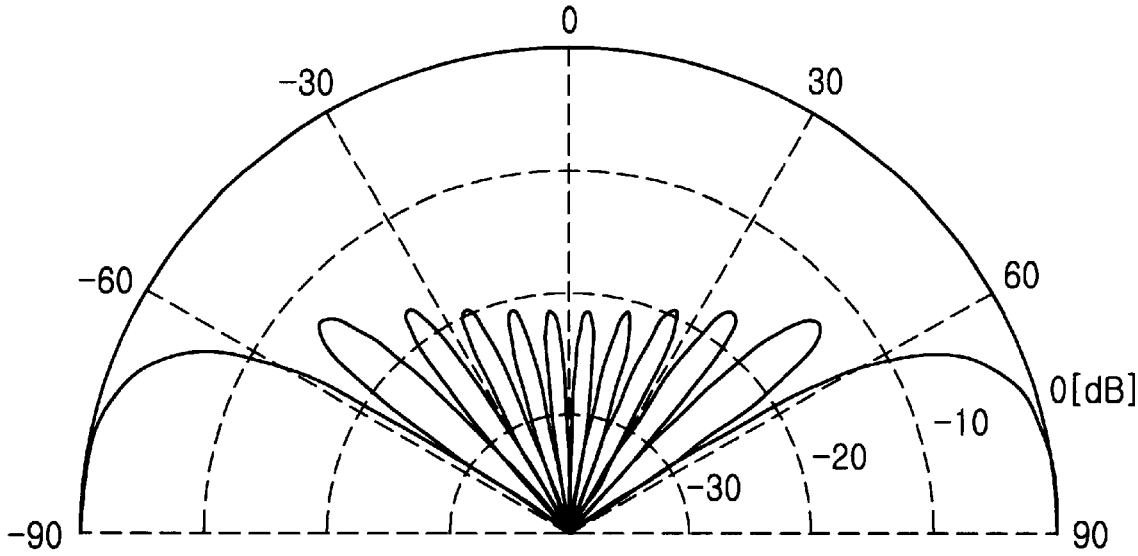
FIG. 6 is a beamforming pattern illustrating a correlation between a weight vector of a calibration signal and a response vector of the array antenna corresponding to each angle.

Referring to FIG. 6, there is shown a beamforming pattern setting forth the correlation of the calibration signal weight vector versus the orientation angle of the array antenna. That is, this figure represents the correlation of the response vector of the array antenna corresponding to each orientation angle versus the calibration signal weight vector when the calibration signal weight vector, i.e., $\alpha$, is fixed to the response vector, i.e., a(90°), of the array antenna corresponding to the orientation angle of 90° in the adaptive array antenna system using a linear array antenna, wherein the orientation angle ranges from −60° to +60°.

Since the beamforming weight vector for use in the adaptive array antenna system bears correlation to the response vector of the array antenna corresponding to the orientation angle ranging of −60° to +60°, the beamforming vector has little correlation to the calibration signal corresponding to the orientation angle of 90°. Accordingly, it is possible to reduce the interference of the calibration signal with the other signal by taking advantage of this range of the orientation angle.

Namely, in order to reduce the interference induced by the calibration signal, the calibration signal weight vector is fixed to the response vector of the array antenna corresponding to the exterior range of the angle which the adaptive array antenna is oriented to.

The inventive method can be stored in a computer-readable media, which is implemented with a program, such as CDROM, RAM, ROM, floppy disk, hard disk, magneto-optical disk, and the like.

As aforementioned, it is possible to reduce the interference with the receiving or the transmitting signal of the array antenna by multiplying the weight vector which has little correlation to the response vector of the array antenna. In addition, the intensity of the calibration signal to be injected into each channel can be increased though the interference condition is identical, thereby estimating the transfer function exactly during the system's working.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A calibration apparatus of an adaptive array receiving antenna system having a plurality of array antennas, the calibration apparatus comprising:

a calibration signal generating means for generating a calibration signal of a baseband as the calibration signal of a radio frequency (RF) band;

a calibration signal injection means for injecting a calibration signal vector into an array receiving means, wherein the calibration signal vector is produced by multiplying a divided signal by a predetermined weight corresponding to each channel, the divided signal being made by dividing the signal received from the calibration signal generating means by total number of channels;

a plurality of array receiving means for adding the signal received from the calibration signal injection means and the signal received by the array antenna devices, and for converting the signal of the RF band into the signal of the baseband;

a calibration coefficient estimation means for estimating a transfer function of each channel by correlating the signal received from the calibration signal generating means with the signal received from the array receiving means, and for finding out a calibration coefficient by using an estimated transfer function; and a calibration means for eliminating an interference component by multiplying the signal received from the array receiving means and the calibration coefficient together.

2. The calibration apparatus as recited in claim 1, wherein the calibration signal injection means includes:

a power divider for dividing the signal received from the calibration signal generating means by total number of channels; and a coupler for injecting the signal received from the power divider multiplied by a predetermined weight into the array receiving means.

3. The calibration apparatus as recited in claim 1, wherein the array receiving means outputs the signal defined by an equation as:

$$y(t) = H_r\left[\sum_i a(\theta_i)s_i(t) + \alpha p(t)\right]$$

where, y(t) is a received data, $s_i(t)$ is an i-th signal received by the array antenna at an angle of $\theta_i$, $a(\theta_i)$ is a column vector in response, to the angle of the array antenna, p(t) is a calibration signal of the baseband, $\alpha=[\alpha_1,\alpha_2,\Lambda,\alpha_M]$ is a weight column vector, and $H_r=\text{diag}\{h_{r,1},h_{r,2},\Lambda,h_{r,M}\}$ is a transfer function corresponding to each receiver.

4. The calibration apparatus as recited in claim 1, wherein the calibration coefficient estimation means estimates the transfer function of the receiver by an equation as:

$$\hat{h}=_r\Lambda^{-1}[E\{y(t)p^*(t)\}]$$

where, $\hat{h}_r=[\hat{h}_{r,1},\hat{h}_{r,2},\Lambda,\hat{h}_{r,M}]^T$ is an estimated transfer function expressed as a column vector, and $\Lambda=[\alpha_1,\alpha_2,\Lambda,\alpha_M]$ is a calibration signal weight matrix expressed as a diagonal matrix.

5. The calibration apparatus as recited in claim 1, wherein the calibration coefficient estimation means finds out a calibration coefficient calculated by an equation as:

$$C_r=diag\{\hat{h}_{r,1}^{-1},\hat{h}_{r,2}^{-1},\Lambda,\hat{h}_{r,M}^{-1}\}$$

where, $C_r$ is a diagonal matrix, wherein each component of the matrix represents a calibration coefficient corresponding to each receiving channel, and $\hat{h}_{r,j}$ is an estimation value of the transfer function of the j-th receiving channel.

6. The calibration apparatus as recited in claim 1, wherein the beamforming means outputs the signal defined by an equation as:

$$P_p=|w^H\alpha|^2\rho_p^2$$

where, $\rho_p^2=E\{|p(t)|^2\}$ is a power of the calibration signal, w is a beamforming weight vector, and $\alpha$ is a calibration signal weight vector.

7. A calibration apparatus of an adaptive array transmitting antenna system having a plurality of array antennas, the calibration apparatus comprising:

a vector addition means for adding each output of each beamforming means;

a calibration signal generating means for generating a calibration signal to be injected into a channel for estimating a transfer function;

a calibration signal injection means for injecting a calibration signal vector added by the signal received from the vector addition means, into a calibration means;

an array transmission means for converting a digital data to an analog data, and for up-converting to an RF band;

a coupling means for interlocking a switch means with the signal received from the array transmission means;

an exchange means for selecting a path or a circuit of the signal received from the coupling means;

a calibration signal receiving means for converting the signal received from the exchange means from the RF band into the baseband;

a calibration coefficient estimation means for finding out a calibration coefficient by using that the transfer function of the array transmission means is estimated sequentially through the calibration signal received from the calibration signal receiving means; and a calibration means for eliminating an interference signal by means of multiplying the signal received from the calibration signal injection means by an inverse of the transfer function estimated from the calibration coefficient estimation means.

8. The calibration apparatus as recited in claim 7, wherein the calibration signal injection means includes:

a multiplication means for multiplying the signal received from the calibration signal generating means by a complex weight; and an addition means for adding the signal received from the vector addition means and the signal received from the multiplication means.

9. The calibration apparatus as recited in claim 7, wherein the calibration signal injection means outputs the signal defined by an equation as:

$$y(t)=\hat{H}_t\left[\sum_i w_i s_i(t)+\alpha p(t)\right]$$

where, y is an output data of the calibration signal injection means, $s_i(t)$ is a data to transmit, $w_i$ is a beamforming weight, p(t) is a calibration signal, and $\alpha$ is a weight vector.

10. The calibration apparatus as recited in claim 7, wherein the calibration coefficient estimation means estimates the transfer function of the array receiving means calculated by an equation as:

$$\hat{h}_t=\Lambda^{-1}[E\{y(t)p^*(t)\}]$$

where, $\hat{h}_t=[\hat{h}_{t,1},\hat{h}_{t,2},\Lambda\hat{h}_{t,M}]^T$ is an estimated transfer function expressed as a column vector, and $\Lambda=\text{diag}\{\alpha_1,\alpha_2,\Lambda,\alpha_M\}$ is a calibration signal weight matrix expressed as a diagonal matrix.

11. The calibration apparatus as recited in claim 7, wherein the calibration coefficient estimation means finds out a calibration coefficient calculated by an equation as:

$$C_t=diag\{\hat{h}_{t,1}^{-1},\hat{h}_{t,2}^{-1},\Lambda,\hat{h}_{t,M}^{-1}\}$$

where, $\hat{h}_{t,j}$ is an estimation value of the transfer function of the j-th receiving channel.

12. The calibration apparatus as recited in claim 7, wherein the array antenna transmits the calibration signal with a power defined by an equation as:

$$P_p=|a^H(\theta)\alpha|^2\rho_p^2$$

where, $\rho_p^2=E\{|p(t)|^2\}$ is the power of the calibration signal, $a(\theta)$ is a response of the array antenna corresponding to an angle of $\theta$, and $\alpha$ is a calibration signal weight vector.

13. A calibration method of an adaptive array receiving antenna, the method comprising the steps of:

a) generating a calibration signal in order to measure a transfer function of an array receiving means;

b) injecting a calibration signal vector into the array receiving means, wherein the calibration signal vector is produced by multiplying a divided calibration signal and a predetermined weight vector corresponding to each channel together, the divided calibration signal being the calibration signal divided by total number of channels;

c) finding out a calibration coefficient by using that the transfer function of each receiving channel is estimated by analyzing the signal injected from the array receiving means; and d) generating a receive signal that an interference signal is eliminated, by multiplying the received signal of a baseband and the calibration coefficient together.

14. The method as recited in claim 13, wherein the step a) includes the step of generating a signal of the RF band.

15. The method as recited in claim 13, wherein the step b) includes the step of injecting a calibration signal vector using a response vector of the array antenna as a calibration signal weight vector into the array receiving means, the response vector of the array vector being correspondent to the exterior range of the angle to which the adaptive receiving array antenna is oriented.

16. A calibration method of in an adaptive array transmitting antenna, the method comprising the steps of:

a) generating a calibration signal in order to measure the transfer function of an array transmission means;

b) injecting a calibration signal vector into the array transmission means, wherein the calibration signal vector is produced by multiplying the calibration signal and a predetermined weight vector corresponding to each channel together;

c) finding out a calibration coefficient by using that the transfer function of each receiving channel is estimated by analyzing a down-converted signal after down-converting the signal injected from the array transmission means; and d) generating a transmission signal that an interference signal is eliminated, by multiplying the transmission signal and the calibration coefficient together.

17. The method as recited in claim 16, wherein the step a) includes the step of generating the calibration signal of the baseband.

18. The method as recited in claim 16, wherein the step b) further includes the step of injecting a calibration signal vector using a response vector of the array antenna as a calibration signal weight vector into the array transmission means, the response vector of the array vector being correspondent to the exterior range of the angle which the adaptive transmission array antenna is oriented to.

19. A computer-readable media storing instructions for executing a calibration method of an adaptive array receiving antenna, the method comprising the steps of:

a) generating a calibration signal in order to measure a transfer function of an array receiving means;

b) injecting a calibration signal vector into the array receiving means, wherein the calibration signal vector is produced by multiplying a divided calibration signal and a predetermined weight vector corresponding to each channel together, the divided calibration signal being the calibration signal divided by total number of channels;

c) finding out a calibration coefficient by using that the transfer function of each receiving channel is estimated by analyzing the signal injected from the array receiving means; and d) generating a receive signal that an interference signal is eliminated, by multiplying the received signal of baseband and the calibration coefficient together.

20. A computer-readable media storing instructions for executing a calibration method of an adaptive array transmitting antenna, the method comprising the steps of:

a) generating a calibration signal in order to measure the transfer function of an array transmission means;

b) injecting a calibration signal vector into the array transmission means, wherein the calibration signal vector is produced by multiplying the calibration signal and a predetermined weight vector corresponding to each channel together;

c) finding out a calibration coefficient by using that the transfer function of each receiving channel is estimated by analyzing a down-converted signal after down-converting the signal injected from the array transmission means; and d) generating a transmission signal that an interference signal is eliminated, by multiplying the transmission signal and the calibration coefficient together.

* * * * *